US005435755A

United States Patent [19]

Chien et al.

[11] Patent Number: 5,435,755

[45] Date of Patent: Jul. 25, 1995

[54] MAINS POWER CONNECTION PLUG STRUCTURE

[76] Inventors: Ming-Chyan Chien, 6F-2, No. 9, Alley 38, Lane 112, Section 2, Chung Shan Rd., Shu Lin, Taipei Hsien; Lai-Sheng Lee, No. 1, Lane 103, Ming Der Street, Shin Chuan, Taipei Hsien, both of Taiwan

[21] Appl. No.: 181,178

[22] Filed: Jan. 13, 1994

[51] Int. Cl.[6] ..... H01R 13/68

[52] U.S. Cl. ..... 439/622; 337/198

[58] Field of Search ..... 439/621, 622; 337/186, 337/198

[56] References Cited

U.S. PATENT DOCUMENTS

| | | | |
|---|---|---|---|
| 1,907,266 | 5/1933 | Mills | 337/186 X |
| 4,196,409 | 4/1980 | Juba | 439/621 X |
| 4,309,069 | 1/1982 | Ahroni | 439/622 |

FOREIGN PATENT DOCUMENTS

| | | | |
|---|---|---|---|
| 524100 | 11/1953 | Belgium | 337/198 |

*Primary Examiner*—Eugene F. Desmond
*Attorney, Agent, or Firm*—Bacon & Thomas

[57] ABSTRACT

A multiple bus fuse tube is secured between the conductor tabs of an outlet prong in a plug connector and is urged outwardly by a spring to permit rotation of the tube and sequentially expose a separate connection point of each bus into electrical connection with a conductor tab, thereby permitting a single fuse tube to be utilized several times before replacement.

5 Claims, 7 Drawing Sheets

MAINS POWER CONNECTION PLUG STRUCTURE

BACKGROUND OF THE INVENTION

Advances in the age of technology, the flourishing development of the manufacturing industry, and the accompanying raising of people's standards of living have enabled a broad range of high technology electrical products to become available on the market which has given rise to a society characterized by the widespread usage of electrical appliances. In term of structural design, most electrical appliances are equipped with safety protection devices to maintain ensured electrical safety within the household living environment, while also preventing damage to the electrical appliance itself. A number of electrical appliances even have fuses built into the mains power connection plug such that in the event of an electrical source problem, the fuse inside the power plug disintegrates and directly interrupts the circuit. This has resulted in the fashioning of many types of safe-usage protection devices which have been conventionally in the form of a fuse installed in the power plug. Although this serves a practical safety function, there are a number of shortcomings that are difficult to eliminate. For example, a conventional fuse tube only has a single bus and the entire fuse tube must be replaced when disintegration occurs. Furthermore, it is not convenient to install and remove the fuse in a conventional power plug because the cover must be lifted and a small sharp object utilized to pry the fuse out, an operation that is impossible to complete within a few seconds. This is the main reason why such types of fuse tubes are seldom seen anymore. Moreover, inexperienced persons often have difficulty purchasing the correct type and all products of this kind pose troublesome problems to users which caused a decline in the utilization of power plug products in this category.

SUMMARY OF THE INVENTION

The invention herein is a kind of mains power connection plug structure, specifically referring to a kind of plug structure that has the safety protection functions of a multiple bus fuse tube that can be utilized many times, wherein the structure consists of an enclosure with an inserted internal holder and within the internal holder are the prongs, the fuse tube, electrical current wires and other related components. On the enclosure is a positioner pressure plate that can be opened and closed, with each operation thereof causing the rotation of the fuse tube to another connection point, thereby not requiring the replacement of the fuse tube, but only the opening and closing of the positioner pressure plate, -which conveniently functions to change the connection points utilized by the fuse tube. Furthermore, since the fuse tube has multiple fuse buses and respective connection points, the invention herein effectively realizes the safety functions of a multiple usage fuse tube.

Figure 5:
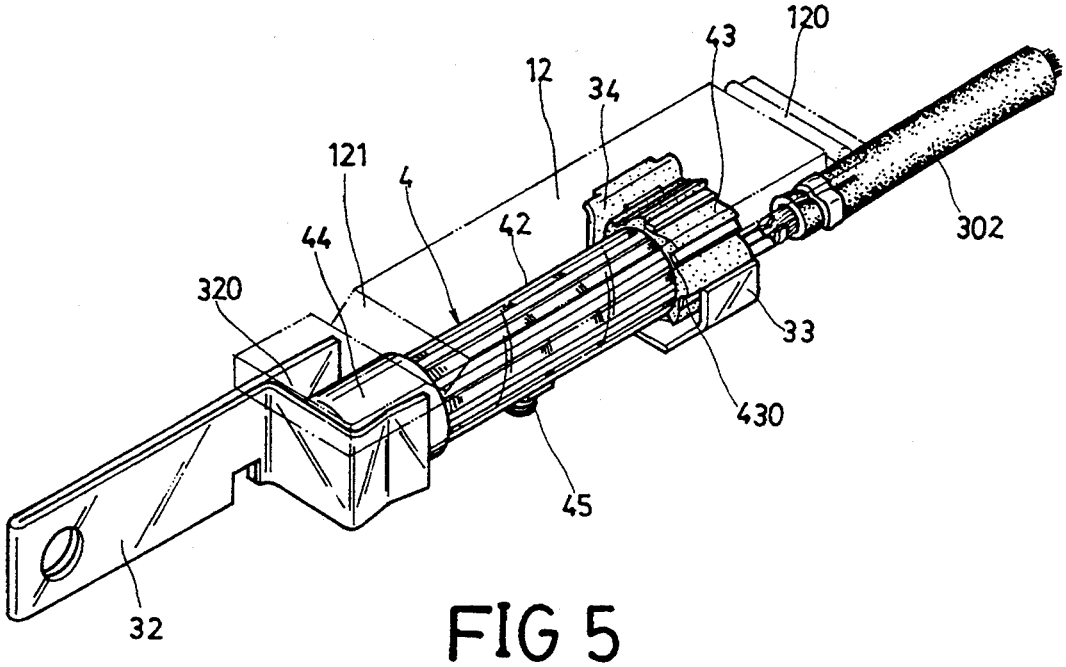
FIG. 5 is an isometric drawing of the fuse tube of the invention herein shown in utilization from an interior perspective of FIG. 1.

FIG, 6 is an exploded drawing of FIG. 5.

Figure 2:
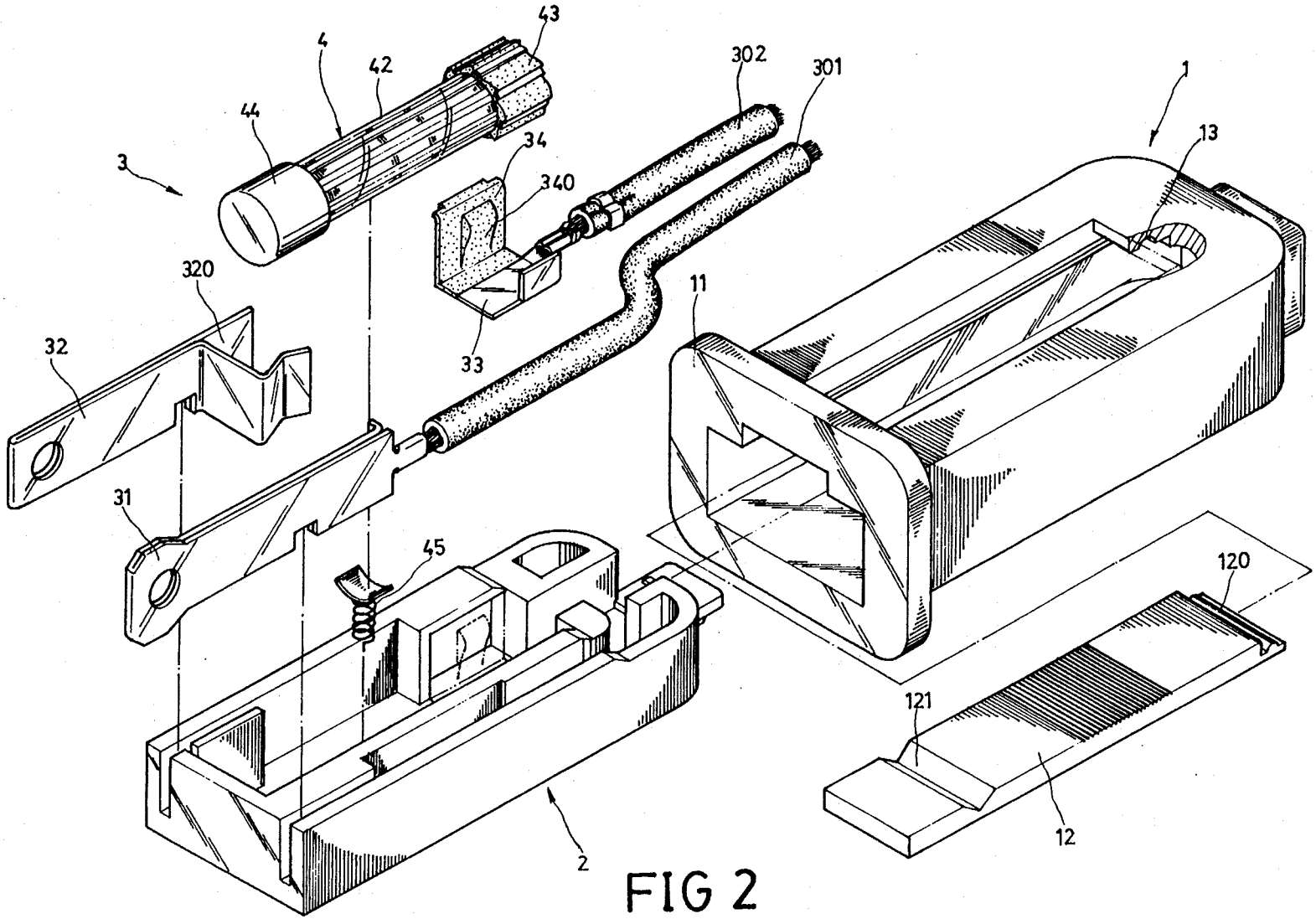
FIG. 2 is an exploded drawing of the structure of the invention herein.
Figure 7:
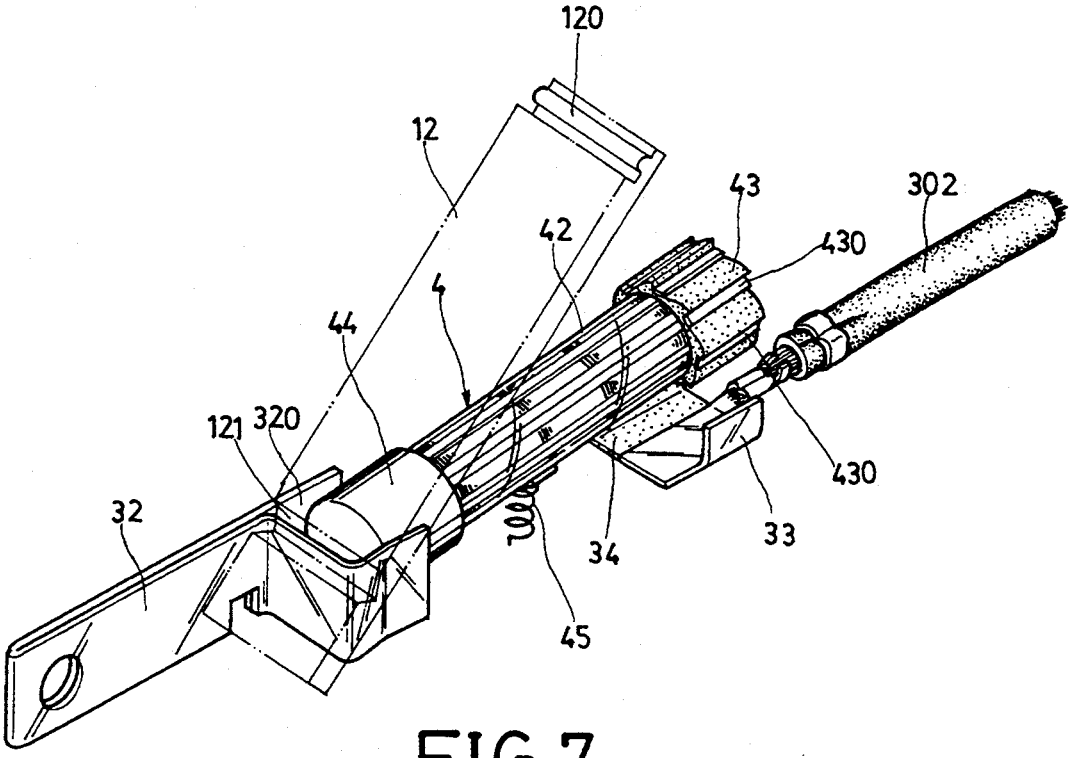

FIG. 7 is an isometric drawing of the fuse tube of the invention herein in utilization relative to the projection in FIG. 2.

Figure 8:
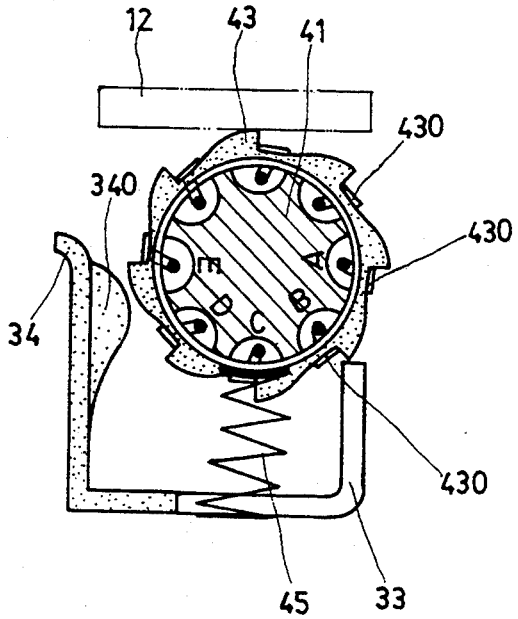

FIG. 8 is an exploded drawing of FIG. 7.

Figure 3:
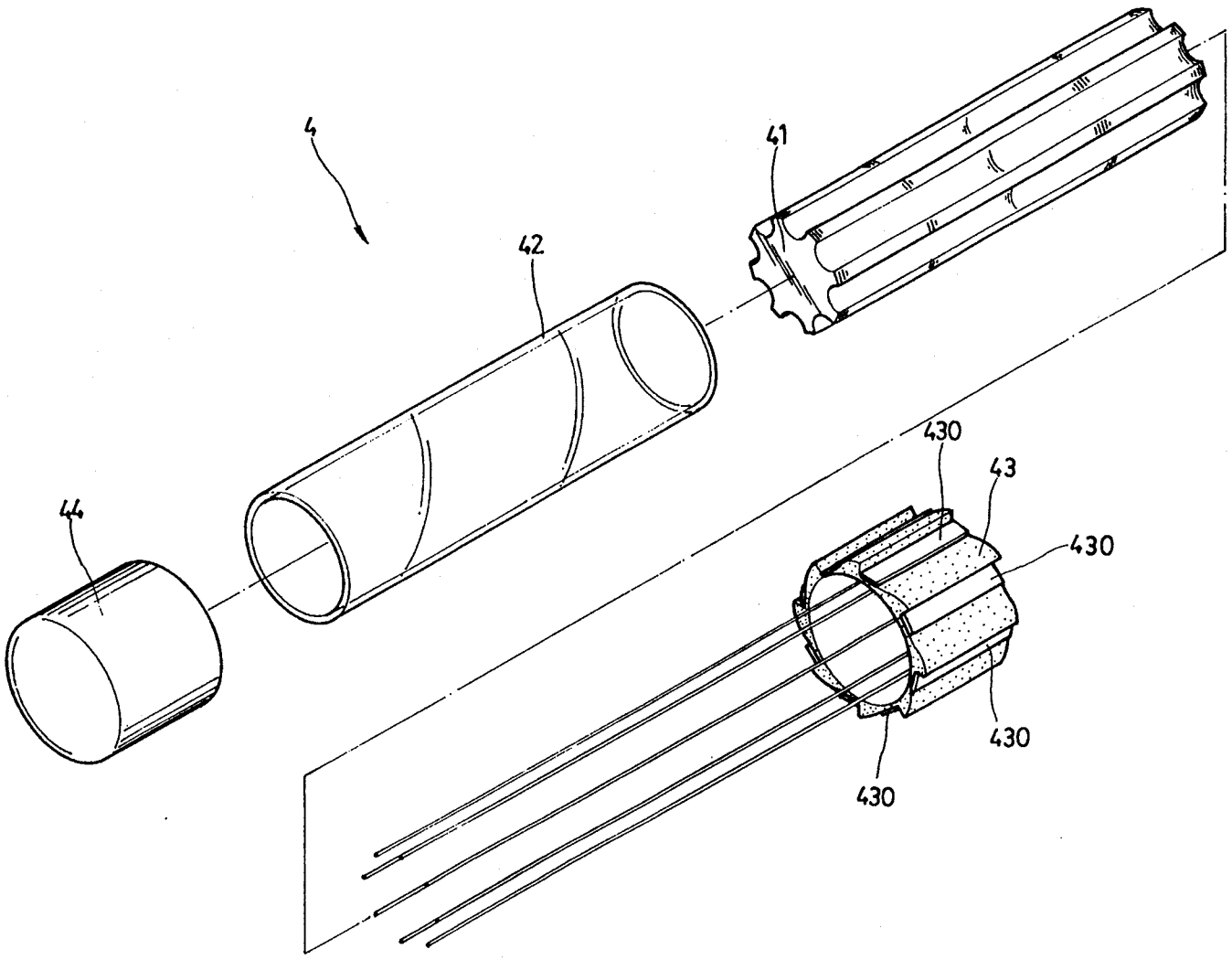
FIG. 3 is an exploded drawing of the fuse structure of the invention herein.
Figure 9:
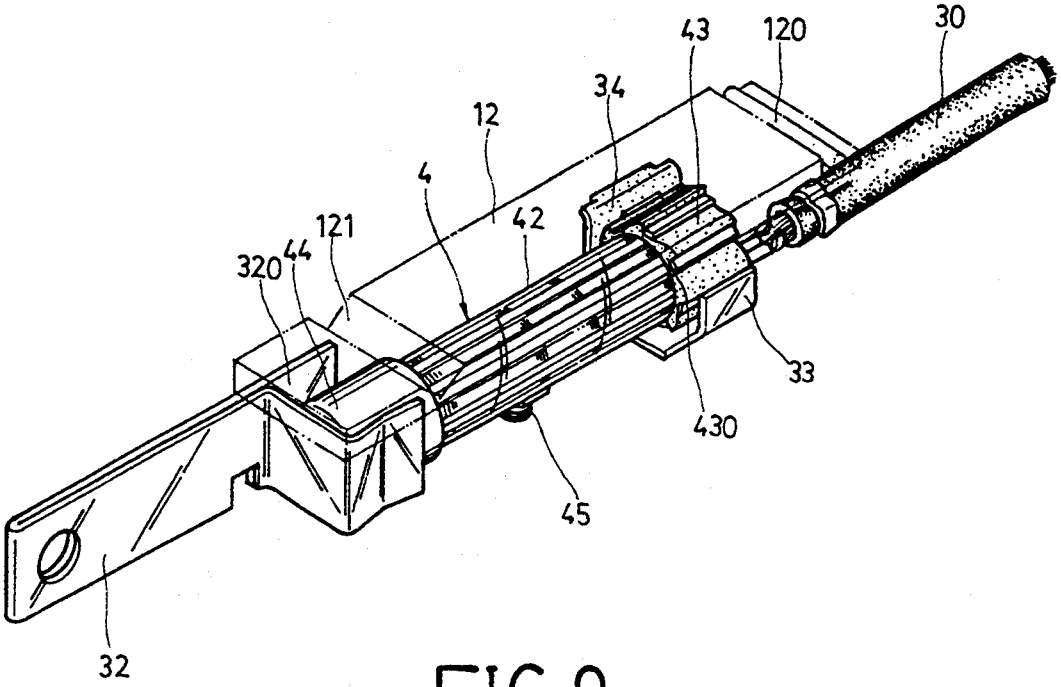

FIG. 9 is an isometric drawing of the fuse tube of the invention herein in utilization relative to the projection in FIG. 3.

Figure 10:
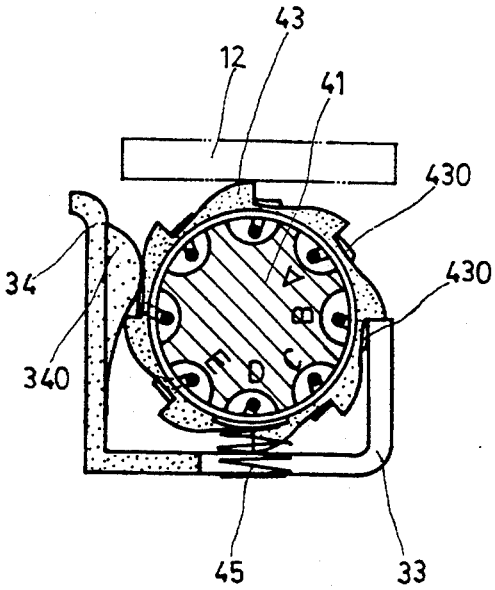

FIG. 10 is an exploded drawing of FIG. 9.

DETAILED DESCRIPTION OF THE PREFERRED EMBODIMENTS

Figure 1:
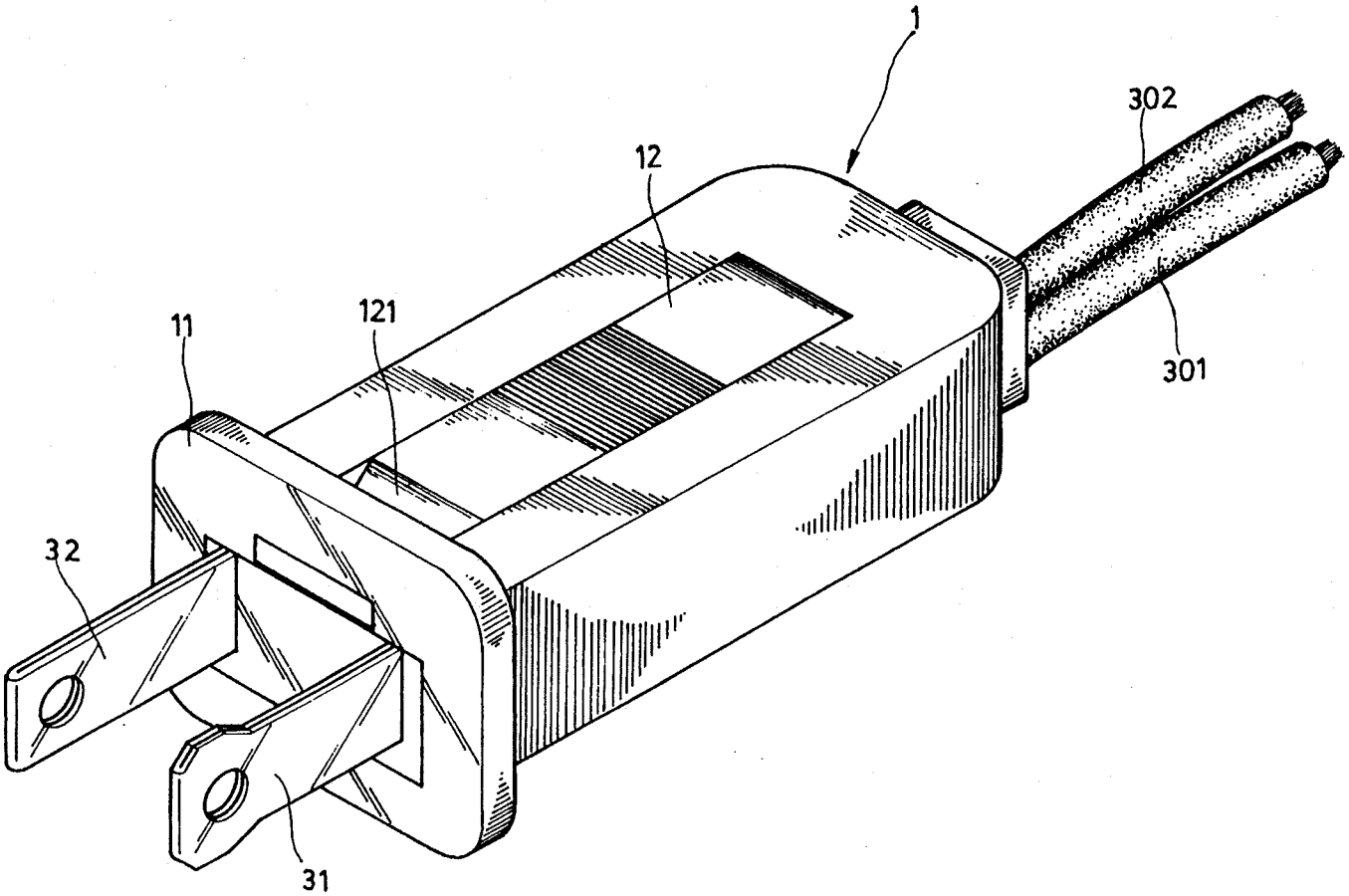
FIG. 1 is an isometric drawing of the invention herein.

As indicated in FIG. 1 and FIG. 2, the invention herein consists of a kind of mains power connection plug structure, specifically a kind of plug in which is utilized an easily replaceable fuse tube to form a multiple-usage safety power connection plug structure that is comprised of and includes an enclosure (1), an internal holder (2), a connection assembly (3), a multiple bus fuse tube (4) and so on; of which, the enclosure (1) consists of a molded resinous insulation structure that has an opening at the front edge and an inner chamber containing the internal holder (2) which is inserted tightly within, and positioned at the front edge is a protruding flange (11); there is a movable positioner pressure plate (12) that fits into a channel through the top surface of the enclosure (1), and at the indented area at the rear end of the positioner pressure plate (12) in the form of a small extrusion is a positioner strip (120) that fits into the insertion slot (13) at the rear end within the aforesaid channel on the enclosure (1) and thereby attains the function of maintaining a fixed position; furthermore, on the forward section of the positioner pressure plate (12) is a V-shaped groove (121) and the groove (121) is designed to accommodate the thickness of the flange (11) on the front edge of the enclosure (1) such that when the groove (121) on the positioner pressure plate (12) is aligned with the flange (11), the space formed by the angle of the groove (121) can be utilized to pry up the positioner pressure plate (12); the internal holder (2) is of an injection-molded resinous insulation structure that fits into the inner chamber of the enclosure (1), and within the internal space of the internal holder (2) are the connection assembly (3) and the fuse tube (4); the connection assembly (3) consists of the components connected to the electrical power source and includes two conductive electrical outlet prongs (31) (32) and two electric current wires (301) (302); of these, the outlet prong (32) is connected to the electrical current wire (302) and at the rear end of the outlet prong (32) is a U-shaped tab (320) that serves as a connection point to the electrical current wire (302) through the L-shaped copper conductor tab (33) which also has a D-shaped insulator surface segment that serves as tip removal tab (34), and the confluence of the conductor tab (33) and the tip removal tab (34) forms a U-shaped connection channel which can be connected to the U-shaped tab (320) at the rear end of the outlet prong (32) and also ensconce the fuse tube (4), such that the outlet prong (32) can be connected to the electrical current wire (302), furthermore, the tip removal tab (34) can be independently fastened or directly attached to a suitable position within the internal holder (2); on the lateral inner surface of the L-shaped copper conductor tab (33) is a protruding arch-shaped tab (340) that presses the end of the fuse tube (4) against the tip removal tab (34) and the U-shaped conductor tab (33) connected to the dectrical conductor wire (302), however, when the aforesaid end of the fuse tube (4) is lifted upward, the protruding arched tab (340) is moved outward; the fuse tube (4) is of a multiple bus arrangement and, furthermore, has several utility sub-structures; as indicated in FIG. 3, there is an internally installed fluted rod (41) that fits into the transparent sleeve (42), thereby forming a number of small passages through which a matching number of fuse buses can be individually inserted and the ends individually attached to the electrical connection points (430) on the splined cap (43), with the opposite ends of the aforesaid fuse buses connected to a standard cap (44) or another splined cap, thus enabling each bus of the fuse tube (4) to be connected in circuit with electric current and thereby serve as a safety protection device; furthermore, at the underside of the fuse tube (4) and situated such that the electrical connection remains unimpeded, is a lifter spring (45) (as indicated previously in FIG. 2) and one end of the lifter spring (45) can be secured at a suitable position inside the internal holder (2), while the other end of the lifter spring (45) supports the fuse tube (4) in an upward manner and, with no additional force applied, the lifter spring (45) causes the splined cap (43) to be pushed upward; the entire structure as assembled and configured consists of conjoining the connection assembly (3) with the fuse tube (4), placing the conjoined connection assembly (3) and fuse tube (4) into the internal holder (2) and then inserting the internal holder (2) in the inner chamber of the enclosure (1), which completes the configuration and assembly procedure of the plug.

Figure 4:
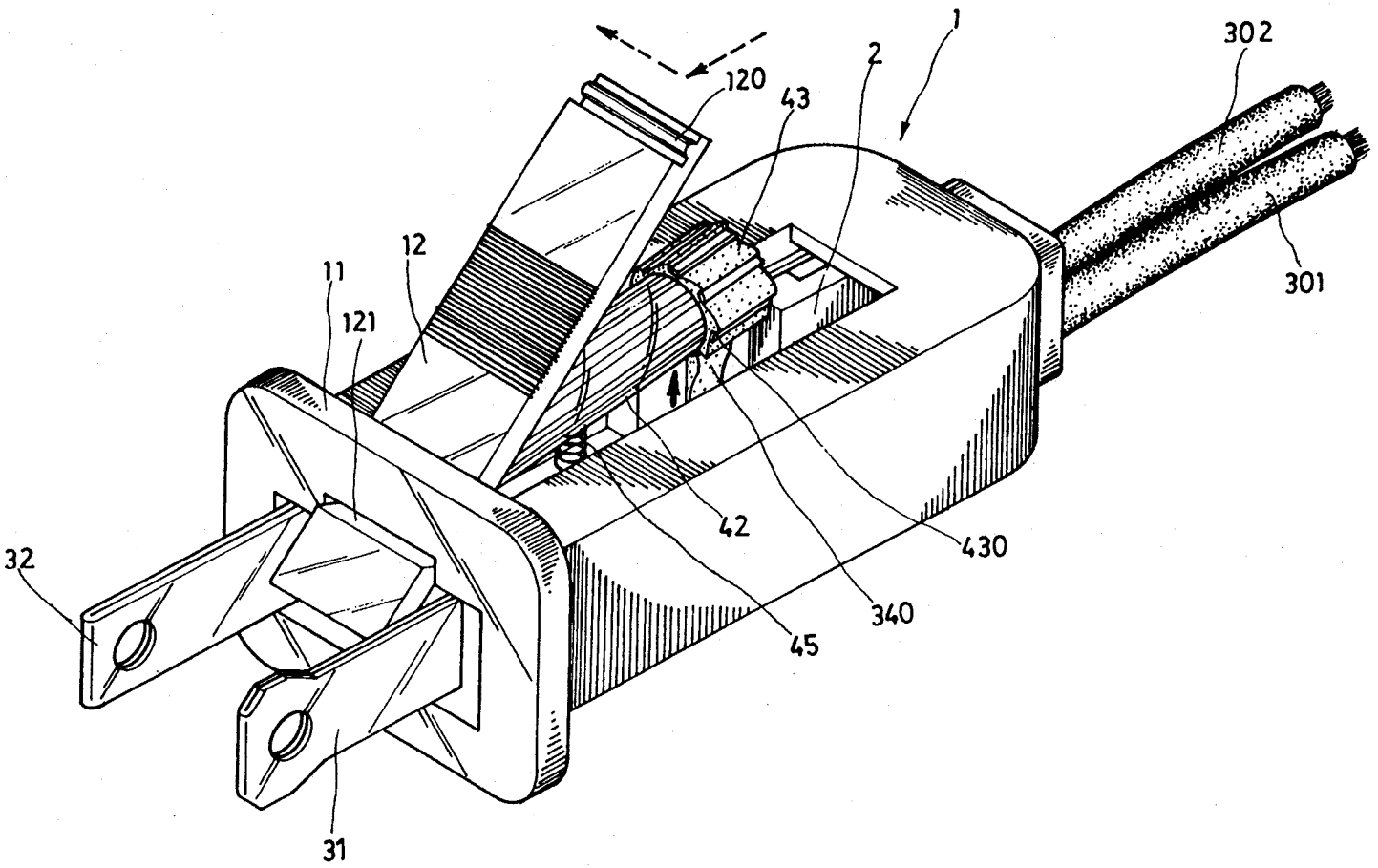
FIG. 4 is an isometric drawing of the invention herein showing the positioner pressure plate of the plug in open mode.
Figure 6:
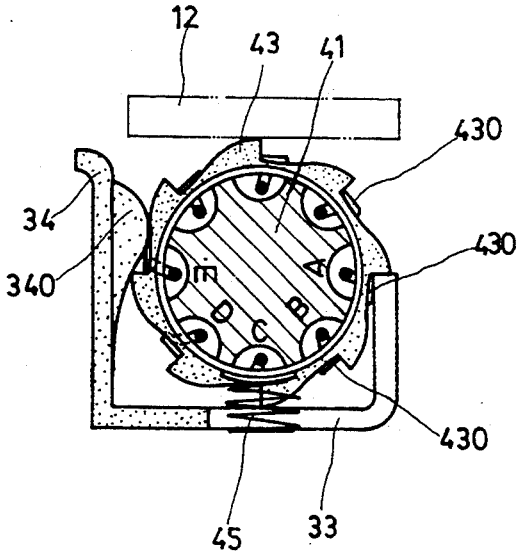

Following complete assembly, the fuse tube (4) inside the plug is located immediately below the positioner pressure plate (12); as indicated in FIG. 4, FIG. 5 and FIG. 6, the lifter spring (45) is compressed by the positioner pressure plate (12) and the fuse tube (4), while the positioner pressure plate (12) presses against the fuse tube (4) to retain the splined cap (43) of the fuse tube (4) inside space formed by the tip removal tab (34) and, furthermore, the electrical connection point (430) A contacts the conductor tab (33) and conducts electric current through the fuse bus fastened to point A, thus performing the safety application protective function; when the fuse bus fastened to point A disintegnates due to excessive electric current flow or other related factors requiring a switch of the bus fuse fastening point, the positioner pressure plate (12) of the enclosure (1) can be pressed downward and pulled to release the positioner strip (120) from engagement with the insertion slot (13) and, furthermore, the front section of the groove (121) is positioned at the underside of the enclosure (1) flange (11), at which time the front section should extend past the flange (11 ), but if the plug has not been removed from the mains power socket and the lower lip of the flange (11) is against the mains power socket, then the positioner pressure plate (12) cannot be opened past the flange (11), however, opening positioner pressure plate (12) is easily accomplished after removing the plug from the mains power socket, and this characteristic serves as built-in protective measure to prevent unknowing individuals such as children and so on from injury; when the groove (121) positioned at the underside of the flange (11), since the positioner pressure plate (12) is no longer engaged and the lifter spring (45) is released, the splined cap (43) of the fuse robe (4) as well as the positioner pressure plate (12) are pushed upward, as indicated in FIG. 7 and FIG. 8; furthermore, after the splined cap (43) is pushed upward, not only is the electrical continuity broken between connection point (430) A and the conductor tab (33), due to the function of protruding arched tab (340) on the tip removal tab (34), the splined cap (43) is also pushed upward by the outward movement of the protruding arched tab (340), thereby causing connection point (430) B of the splined cap (43) become positioned immediately above the conductor tab (33); when the positioner pressure plate (12) is pressed down once again, the splined cap (43) of the fuse tube (4) moves downward perpendicularly, causing the upper end of the conductor tab (33) to contact the connection point (430) B, as indicated in FIG. 9 and FIG. 10, resulting in the conductance of electric current through the fuse bus fastened to point B; during the foregoing single opening and closing operation of the positioner pressure plate (12) has already cause the fuse tube (4) to transfer the conductance of electric current from the mode at point A to the mode at point B and, furthermore, described the specific function of the splines on the splined cap (43); when the connection point (430) B of the splined cap (43) is in contact with the conductor tab (33), and the positioner pressure plate (12) is pressing down to maintain the position, this should cause the fuse tube (4) to remain positioned accordingly when the splines on the splined cap (43) are rotated; given such rotational and positioning properties, each bus within the fuse tube (4) fastened to a connection point can be fully utilized for the purpose of safety, and each bus changing procedure only requires a single opening and closing of the positioner pressure plate (12), which constitutes a major improvement over conventional mains power plugs that have the shortcoming of requiring the complete removal and replacement of the fuse tube and, furthermore, offers a single fuse tube of a multiple bus as well as multiple connection point design that is functionally more economical.

Therefore, be it acknowledged that major objectives of the invention herein refer to the offering of a kind of mains electrical power connection plug structure having simple structural and installation characteristics that is a mains electrical power connection plug that is safe and effective to utilize and, furthermore, when the a bus within the fuse tube disintegrates due to excessive current flow, the connection point can be transferred to the next fuse bus simply and rapidly by opening and closing the cover of the plug of the invention herein once, thus substantiating the invention herein has attained the innovative objectives of convenience and economical price.

What is claimed is:

1. A power connection plug structure comprising:

a) an enclosure having an inner chamber, an open end and an open top channel;

b) an internal holder receivable within the inner chamber of the enclosure through the open end;

c) a fuse connection assembly disposed within the holder and including first and second outlet prongs for connection to a pair of electric wires, the first outlet prong including a first conductor tab for detachably securing of a fuse tube between the first outlet prong and a second conductor tab of an electric wire, and means for biasing an end of the fuse tube out of engagement with the second conductor tab;

d) a pressure plate for opening and dosing the top channel of the enclosure, and for maintaining the end of the fuse tube in engagement with the second conductor tab when the pressure plate is in the closed position;

e) a fuse tube including multiple conductor buses therein for engagement within the first and second conductor tabs, all of the buses having a single connection point at a first end of the tube for engagement in the first conductor tab and plural connection points at a second end of the tube for engagement with the second conductor tab; and f) means carried by the second end of the fuse tube and the second conductor tab for permitting the fuse tube to be rotated during the disengagement and engagement of the second end thereof with respect to the second conductor tab when the pressure plate is opened and closed, thereby permitting sequential connection of each bus with the second conductor tab.

2. The plug structure of claim 1 wherein the means for rotating the fuse tube includes:

a) a splined cap at the second end of the fuse tube, with each bus connection being disposed between adjacent splines; and b) the second conductor tab including a tip removal tab and defining a substantially U-shaped configuration therewith, and an arch-shaped tab provided on an inner surface of the tip removal tab.

3. The plug structure of claim 1 wherein the means for urging the fuse tube out of engagement with the second conductor tab includes a spring.

4. The plug structure of claim 1 wherein:

a) the enclosure includes a front flange surrounding the open end and an insertion slot disposed at one end of the top channel; and b) the pressure plate includes a positioner strip for detachable engagement within the insertion slot to secure the pressure plate in its closed position and a groove for engaging the flange when the pressure plate is in the open position.

5. The plug structure of claim 1 wherein the fuse tube includes a transparent sleeve, a fluted rod disposed within the transparent sleeve, the individual buses being positioned between the flutes of the rod, the first end of the tube including a cylindrical cap and the second end of the tube including a splined cap.

* * * * *